US010036106B2

(12) United States Patent
Winzen

(10) Patent No.: US 10,036,106 B2
(45) Date of Patent: Jul. 31, 2018

(54) YARN WITHDRAWAL NOZZLE FOR AN OPEN-END ROTOR SPINNING MACHINE

(71) Applicant: Saurer Germany GmbH & Co. KG, Remscheid (DE)

(72) Inventor: Lothar Winzen, Herzogenrath (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 78 days.

(21) Appl. No.: 15/181,602

(22) Filed: Jun. 14, 2016

(65) Prior Publication Data

US 2016/0376731 A1 Dec. 29, 2016

(30) Foreign Application Priority Data

Jun. 25, 2015 (DE) ..... 10 2015 008 168

(51) Int. Cl.
*D01H 4/40* (2006.01)

(52) U.S. Cl.
CPC ..... *D01H 4/40* (2013.01)

(58) Field of Classification Search
CPC ..... D01H 4/10; D01H 4/40
See application file for complete search history.

(56) References Cited

U.S. PATENT DOCUMENTS 4,110,961 A * 9/1978 Havel ..... D01H 4/40 57/349
5,555,715 A * 9/1996 Paweletz ..... D01H 4/10 310/86
5,638,671 A * 6/1997 Stahlecker ..... D01H 4/40 57/352
5,768,881 A * 6/1998 Lauschke ..... D01H 4/40 57/404
7,155,894 B2 * 1/2007 Gatzke ..... D01H 4/40 57/417
2004/0032247 A1 * 2/2004 Chen ..... G01R 1/0408 324/750.14
2004/0255569 A1 * 12/2004 Stahlecker ..... D01H 4/40 57/417
2006/0137321 A1 * 6/2006 Gatzke ..... D01H 4/40 57/417

(Continued)

FOREIGN PATENT DOCUMENTS

DE 2745195 A1 4/1978
DE 3729425 A1 9/1988

(Continued)

OTHER PUBLICATIONS

European Search Report for corresponding European Patent Application No. 16001238.1 dated Oct. 24, 2016.

*Primary Examiner* — Shaun R Hurley
(74) *Attorney, Agent, or Firm* — Nelson Mullins Riley & Scarborough LLP

(57) ABSTRACT

A yarn withdrawal nozzle 13 for an open-end rotor spinning device 1 with at least two ferromagnetic projections for magnetically coupling to permanent magnets 31 arranged in depressions of a holder in the cover element 8 of a rotor housing 2, wherein the ferromagnetic projections correspond in their arrangement and dimensions to the depressions 30 in the holder. The ferromagnetic projections are formed directly in the yarn withdrawal nozzle 13 made from a non-magnetic material.

3 Claims, 3 Drawing Sheets

(56) References Cited

U.S. PATENT DOCUMENTS

| | | | | |
|---|---|---|---|---|
| 2010/0283269 | A1* | 11/2010 | Fiedler | A44B 11/258<br>292/251.5 |
| 2010/0285937 | A1* | 11/2010 | Anderson | A63B 21/0728<br>482/107 |
| 2013/0263625 | A1* | 10/2013 | Taylor-Cattapan | A44C 17/0258<br>63/4 |
| 2014/0366242 | A1* | 12/2014 | Pulsifer | A41B 3/04<br>2/139 |

FOREIGN PATENT DOCUMENTS

| | | | |
|---|---|---|---|
| DE | 19502917 | A1 | 8/1996 |
| DE | 19532735 | A1 | 3/1997 |
| DE | 103 26 847 | A1 | 9/2004 |
| DE | 10329612 | A1 | 1/2005 |
| DE | 10 2004 013 828 | A1 | 10/2005 |
| DE | 102008019214 | A1 | 10/2009 |

* cited by examiner

YARN WITHDRAWAL NOZZLE FOR AN OPEN-END ROTOR SPINNING MACHINE

FIELD OF THE INVENTION

The invention relates to a yarn withdrawal nozzle for an open-end rotor spinning machine and, more particularly, to a yarn withdrawal nozzle for an open-end rotor spinning machine comprising at least two ferromagnetic projections for magnetically coupling to permanent magnets arranged in depressions of a holder in the cover element of a rotor housing, wherein the ferromagnetic projections correspond in their arrangement and dimensions with the depressions in the holder.

BACKGROUND OF THE INVENTION

Yarn withdrawal nozzles can be secured replaceably for example in a so-called channel plate adapter of a cover element closing the open-end rotor spinning machine during the spinning operation. As the yarn withdrawal nozzles are subject to heavy wear from the running yarn, they usually consist of a funnel-like nozzle insert which is made from a very wear-resistant material, preferably a technical ceramic material, and is secured permanently in a nozzle fitting made from a metal material, for example by an adhesive or press-fitting connection.

The channel plate adapter consists essentially of a preferably circular basic body with a rear, conically designed bearing surface and an outlet part which projects during the spinning operation into the spinning rotor and the dimensions of which are adjusted to a specific spinning rotor diameter or diameter range.

The outlet area of a so-called fiber guiding channel is also formed in said outlet part of the channel plate adapter.

Such channel plate adapters have a central through bore, in which on the input side the yarn withdrawal nozzle is secured replaceably and in which on the outlet side a so-called yarn take-off tube engages.

The yarn withdrawal nozzle secured replaceably in the central through bore of a channel plate adapter generally consists, as shown for example in German Patent Publication DE 10 2008 019 214 A1, of a special nozzle fitting and a ceramic nozzle insert secured permanently onto the nozzle fitting.

The generally ferromagnetic nozzle setting corresponds with corresponding permanent magnets embedded in the channel plate adapter, which secure them in a force-fitting manner.

Such yarn withdrawal nozzles that have been known for a long time have proved effective in practice and make it possible to create optimal spinning conditions in open-end spinning devices.

The disadvantage of these yarn withdrawal nozzles is however that they are very expensive to manufacture and thus have a relatively high cost. For example the configuration of the transition from the nozzle insert to the nozzle setting is particularly complex to avoid the formation of any welt edges which would have a negative effect on the quality of the yarn because of the additional friction. Owing to the fit of the nozzle insert and nozzle setting in addition only small deviations are permissible in manufacturing which results in high production costs caused by rejects or the post-processing of parts.

Additional magnetically fixable yarn withdrawal nozzles are disclosed for example by German Patent Publications DE 27 45 195 A1, DE 37 29 425 A1 or DE 195 02 917 A1.

As shown in particular in German Patent Publication DE 27 45 195 A1, such a yarn withdrawal nozzle is made either of ferromagnetic material or a ceramic material with a ferromagnetic ring.

The yarn withdrawal nozzle according to German Patent Publication DE 37 29 425 A1 is also made of ceramic material and has a ferromagnetic disc which corresponds with a magnetic ring disc which is attached to the holder. In order that the fiber feed channel can be guided past the magnetic ring disc is missing a sector of about 60°.

The disadvantage of the yarn withdrawal nozzles according to German Patent Publications DE 27 45 195 A1 or DE 37 29 425 A1 is that no anti-rotation device is provided for the yarn withdrawal nozzle in the holder. This can mean, particularly with difficult yarns, that the magnetic fixing of the yarn withdrawal nozzle is not sufficient and the yarn withdrawal nozzle co-rotates in its holder which has a negative effect on the forming yarn.

From German Patent Publication DE 195 02 917 A1 therefore a yarn withdrawal nozzle is disclosed which in addition to the magnetic coupling ensures a desired installation position and also facilitates the release of the magnetic coupling.

In addition, the yarn withdrawal nozzle comprises a positioning means which in a different installation position of the yarn withdrawal nozzle than the one intended weakens the magnetic effect on the bearing surface at least. This is achieved in that the positioning means contains a cam-like catch securing the installation position which can be inserted into a recess of the holder.

To facilitate the release of the magnetic coupling, in addition a so-called uncoupling device is disclosed which is formed either by a recess provided in the bearing surface or by a support surface lifting the bearing surface from the holder. Said uncoupling devices have a lifting or weakening effect on the magnetism so that the yarn withdrawal nozzle can be disassembled more easily.

By using yarn withdrawal nozzles according to German Patent Publication DE 195 02 917 A1 an anti-rotational securing of the yarn withdrawal nozzle is ensured in its holder, but only with a very specific configuration of the yarn withdrawal nozzle and a very specific installation position. In addition, such yarn withdrawal nozzles are expensive to manufacture. A tool is generally necessary for the installation and disassembly in order to lock the yarn withdrawal nozzle to be used or in order to release the engaged yarn withdrawal nozzle.

SUMMARY OF THE INVENTION

The present invention therefore seeks to create a yarn withdrawal nozzle which is easy to assemble and during the spinning operation does not co-rotate in its holder. Furthermore, the yarn withdrawal nozzle should be easy and inexpensive to produce.

The yarn withdrawal nozzle of the invention is adapted for an open-end rotor spinning device with at least two ferromagnetic projections for magnetically coupling to permanent magnets arranged in depressions of a holder in the cover element of a rotor housing, wherein the ferromagnetic projections correspond in their arrangement and dimensions with the depressions in the holder. According to the invention, the ferromagnetic projections are formed directly in the yarn withdrawal nozzle (13) made from a non-magnetic material.

By means of the ferromagnetic projections, which are formed/pressed directly into the yarn withdrawal nozzle, a yarn withdrawal nozzle can be used which is itself not magnetic but is homogenous in its composition/assembly.

In this way not only is adequate fixing in the channel plate adapter ensured but also a simple positioning is made possible and the correct installation of the yarn withdrawal nozzle in the channel plate adapter is guaranteed. The yarn withdrawal nozzle according to the invention now only has to be held on the surface of the channel plate adapter and snaps independently of its angular position due to magnetism into the correct installation position in the channel plate adapter.

To take apart the yarn withdrawal nozzle it is sufficient if the yarn withdrawal nozzle is grasped by the fingers and removed from the holder in the channel plate adapter; it is not necessary to use a tool.

Furthermore, by means of the at least two ferromagnetic projections a functional form-fitting anti-rotational securing of the yarn withdrawal nozzle in the channel plate adapter is achieved.

The yarn withdrawal nozzle designed with ferromagnetic projections is simple and inexpensive to manufacture, as for example no tolerances have to be taken into account for the individual parts both for the manufacture and assembly. According to the invention there is no longer a welt on the two individual parts of the prior art which would have a negative effect on the quality of the yarn.

The configuration of the yarn withdrawal nozzle according to the invention provides a range of additional advantages.

As there is no longer a nozzle insert or nozzle setting the whole yarn guiding area is made from a non-magnetic material. This has a positive effect on the lifetime of the yarn withdrawal nozzle, which is subject to a high degree of wear.

Previously, a high requirement specification was defined for the selection of the material for the nozzle setting with respect to the hardness, absence of burr, surface quality and/or surface coating, so that the nozzle setting was as wear-resistant as the usually used nozzle insert. This is no longer necessary with the solution according to the invention.

A further advantage of the yarn withdrawal nozzle within the meaning of the invention is that the labelling or marking no longer has to be applied afterwards in an additional process onto a yarn withdrawal nozzle, but can be integrated into the latter directly during the production of the yarn withdrawal nozzle. This not only reduces the manufacturing costs again, but ensures a durable labelling/marking.

Overall it can be established that as well as the advantages relating to the production, assembly and handling of the yarn withdrawal nozzle according to the invention, the use of such a yarn withdrawal nozzle has a positive influence on the quality of the yarn to be produced.

Within the scope of this invention the term ferromagnetic material is defined as any material that either creates a static magnetic field itself or which is attracted by a pole of an external magnetic field, regardless of whether it is a north or south pole. For example iron has ferromagnetic properties, but also nickel, cobalt and ferromagnetic alloys. However, ferromagnetic materials do not have a permanently aligned south or north pole and their magnetic properties originate from external magnetic fields.

In particular, the projections are made from magnets which have a polarity which is opposite the polarity of the permanent magnets in the holder.

In this case the magnet used in the yarn withdrawal nozzle has to have an opposite polarity to the permanent magnet, which is attached in the cover element of the channel plate adapter.

In particular, the ferromagnetic projections are designed as cylinder pin-shaped bolts.

Bolts or pins are connecting elements which are simple and inexpensive to produce which can be inserted or pressed easily into the non-magnetic material of the yarn withdrawal nozzle.

Owing to the simple and inexpensive production of bolts, which are for example simply extruded and cut to size accordingly, such a configuration of the ferromagnetic projections reduces the production costs of the whole yarn withdrawal nozzle.

According to another feature of the invention, the yarn withdrawal nozzle is made from a ceramic material.

In a preferred configuration of the invention ceramic is the preferred material for the production of yarn withdrawal nozzles, as ceramic also has a high mechanical strength, good abrasion and wearing properties and has a high degree of hardness.

Of course, within the scope of this application yarn withdrawal nozzles are also possible which are not made from ceramic material, but alternatively are made of plastic or laminates.

BRIEF DESCRIPTION OF THE DRAWINGS

The invention is explained in more detail in the following with reference to an example embodiment shown in the drawings, wherein.

DETAILED DESCRIPTION OF THE INVENTION

Figure 1:
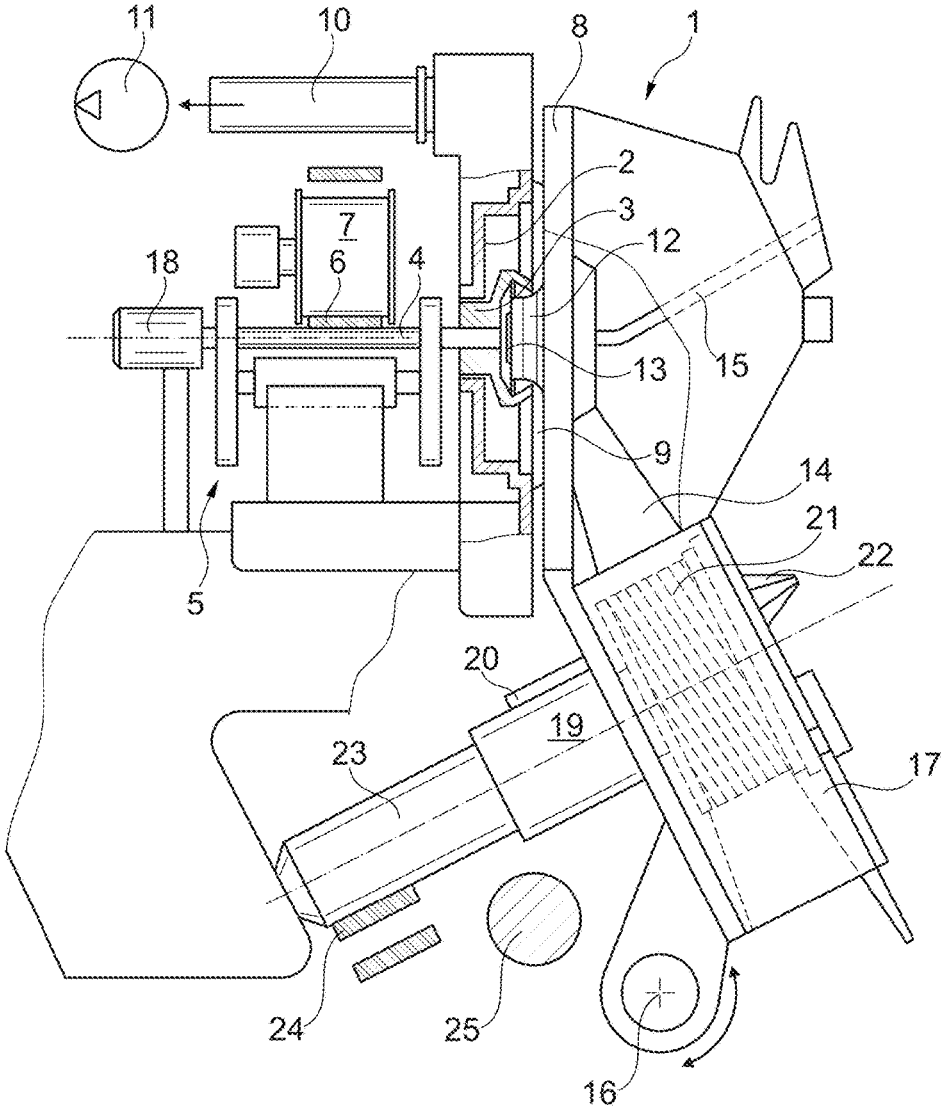
FIG. 1 shows schematically in side view, partly in cross-section, an open-end spinning device, in which the yarn withdrawal nozzle according to the invention is used.

FIG. 1 shows schematically an open-end rotor spinning device 1. Such open-end-spinning devices 1 have, as already known, a rotor housing 2, in which the spinning cup of a spinning rotor 3 rotates at high speed.

The spinning rotor 3 is thus supported for example by its rotor shaft 4 in the bearing gores of a so-called support disc bearing 5 and is driven frictionally by a machine-length tangential belt 6, which is loaded by a pressing roller 7.

The axial fixing of the rotor shaft 4 is performed for example by a permanent magnetic axial bearing 18.

The rotor housing 2 open to the front is closed during the spinning operation by a pivotably mounted cover element 8, in which a channel plate is formed which bears with a rotating lip seal 9 on the rotor housing 2.

The rotor housing 2 is also connected by a corresponding negative pressure line 10 to a negative pressure source 11, which produces the negative spinning pressure required in the rotor housing 2.

In a mount of the channel plate (not shown in more detail) a channel plate adapter 12 is arranged replaceably, which comprises the outlet area of a fiber guiding channel 14 and a yarn withdrawal nozzle 13 according to the invention to which a yarn take-off tube 15 is connected.

Furthermore, a sliver opening device is integrated into the cover element 8, which is mounted to be rotatable about a pivot axis 16 to a limited degree.

This means that the cover element 8 has an opening roller housing 17 and rear bearing consoles 19, 20 for supporting an opening roller 21 or a sliver draw-in cylinder 22.

The opening roller 21 is driven by a rotating machine-length tangential belt 24, which loads a whorl 23 of the opening roller 21, whereas the drive of the sliver draw-in cylinder 22 is preferably performed over a machine-length drive shaft 25 or a (not shown) worm wheel gear.

Figure 2:
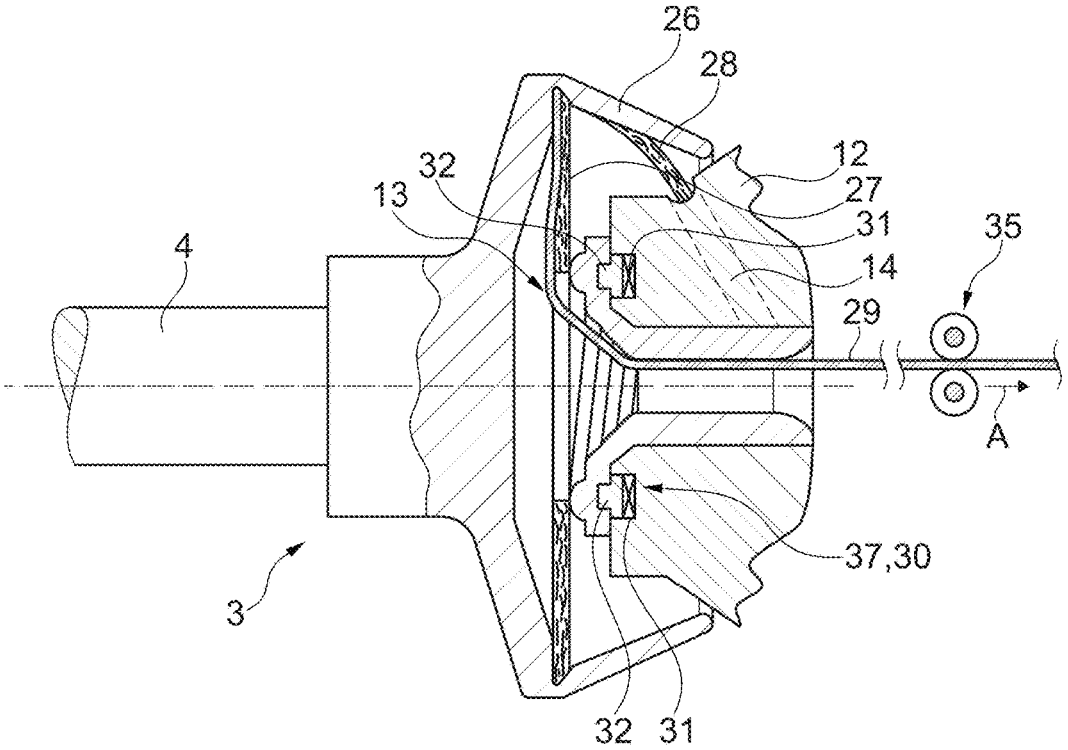
FIG. 2 shows a spinning rotor with a yarn withdrawal nozzle according to the invention in the channel plate adapter.

As shown in FIG. 2 on a larger scale, the yarn withdrawal nozzle 13 according to the invention is arranged in a central through bore of a channel plate adapter 12 and is positioned during the spinning process inside the spinning cup 26 of the spinning rotor 3 which is open towards the front.

The spinning cup 26, which comprises a so-called rotor groove 27, rotates, as already indicated above, at high speed inside the rotor housing 2.

The individual fibers 28 opened by the opening roller 21 from a (not shown) feed sliver are fed via the fiber guiding channel 14 into the spinning rotor 3 and, as is usual in open-end rotor spinning devices, are firstly collected in the region of the rotor groove 27 of the spinning rotor 3.

In a so-called binding area the individual fibers 28 are rotated onto a yarn 29 which is then drawn off via the yarn withdrawal nozzle 13 out of the spinning rotor 3.

The yarn take-off speed, at which the new yarn 29, which rolls or slides during take-off over the surface of the yarn withdrawal nozzle 13, is drawn off in direction A from the open-end spinning device 1, is dependent on various factors, such as for example the rotor speed, the desired yarn rotation etc., and can be adjusted in a defined manner by a yarn take-off device 35.

The yarn withdrawal nozzle 13 is connected by magnetic connection 37 to the channel plate adapter 12, if necessary so as to be easily detachable.

Figure 3:
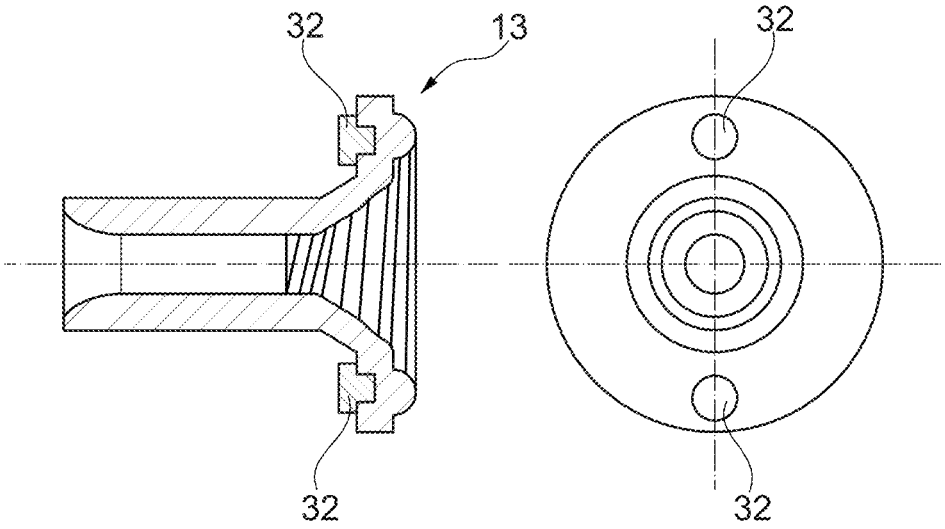
FIG. 3 shows a yarn withdrawal nozzle according to the invention in side and plan view.

As shown in FIG. 3, the yarn withdrawal nozzle 13 according to the invention comprises two ferromagnetic projections designed as bolts 32 in the form of cylindrical pins. The bolts 32 correspond with depressions 30 of the cover element 8 at the end of which a permanent magnet 31 is arranged respectively.

If a yarn withdrawal nozzle 13 is inserted into the channel plate adapter 12 it is thus sufficient to position the yarn withdrawal nozzle 13 on the surface of the channel plate adapter 12. By means of the embodiment according to the invention the yarn withdrawal nozzle 13 is pulled by means of magnetism independently into the right installation position and snaps in.

If a yarn withdrawal nozzle 13 according to the invention is removed from the channel plate adapter 12 it is thus sufficient if the yarn withdrawal nozzle 13 is grasped by fingers and rotated out of the cover element 8. It is not necessary to use a tool.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Yarn withdrawal nozzle (13) for an open-end rotor spinning device (1) with at least two ferromagnetic projections for magnetically coupling to permanent magnets (31) arranged in depressions (30) of a holder in the cover element (8) of a rotor housing (2), wherein the ferromagnetic projections correspond in their arrangement and dimensions with the depressions (30) in the holder, the yarn withdrawal nozzle (13) is made from a non-magnetic material, characterised in that, the ferromagnetic projections are designed as cylinder pin-like bolts (32) which are inserted or pressed into the non-magnetic material of the yarn withdrawal nozzle.

2. Yarn withdrawal nozzle according to claim 1, characterised in that the projections consist of magnets, which have a polarity that is opposite the polarity of the permanent magnets (31) in the holder.

3. Yarn withdrawal nozzle according to claim 1, characterised in that the yarn withdrawal nozzle (13) is made from a ceramic material.

* * * * *